United States Patent [19]

Barnett

[11] Patent Number: 5,050,943

[45] Date of Patent: Sep. 24, 1991

[54] BIOLOGICAL SAFETY CABINET WITH WINDOW COUNTERBALANCE

[75] Inventor: Dale C. Barnett, Marietta, Ohio

[73] Assignee: Forma Scientific, Inc., Marietta, Ohio

[21] Appl. No.: 514,848

[22] Filed: Apr. 24, 1990

[51] Int. Cl.[5] ..... A47B 95/00

[52] U.S. Cl. ..... 312/319; 312/209; 49/445; 160/190

[58] Field of Search ..... 312/209, 138.1, 139, 312/139.2, 319; 49/445; 160/189, 190, 331; 16/1 C, 84, 194

[56] References Cited

U.S. PATENT DOCUMENTS

| | | | |
|---|---|---|---|
| 3,026,560 | 3/1962 | Starck | 49/445 |
| 3,934,496 | 1/1976 | Turko | 49/445 |
| 4,307,874 | 12/1981 | Reuschenbach et al. . | |
| 4,342,355 | 8/1982 | Geller et al. | 160/331 |
| 4,373,707 | 2/1983 | Molders . | |
| 4,406,240 | 9/1983 | Andersen . | |
| 4,423,536 | 1/1984 | Cross . | |
| 4,844,567 | 7/1989 | Chalabian | 312/139 |

FOREIGN PATENT DOCUMENTS

| | | | |
|---|---|---|---|
| 74880 | 3/1983 | European Pat. Off. | 16/1 C |
| 928149 | 3/1955 | Fed. Rep. of Germany | 49/445 |
| 1231975 | 4/1960 | France | 49/445 |

*Primary Examiner*—Kenneth J. Dorner
*Assistant Examiner*—Brian K. Green
*Attorney, Agent, or Firm*—Wood, Herron & Evans

[57] ABSTRACT

A biological safety cabinet vertical lift assist system employing one or more pneumatic springs operatively connected to the cabinet and sliding window to counterbalance the window's weight to provide a substantially constant brake force spring resulting in smoother and easier operation of the window.

3 Claims, 2 Drawing Sheets

BIOLOGICAL SAFETY CABINET WITH WINDOW COUNTERBALANCE

BACKGROUND OF THE INVENTION

This invention relates to biological safety cabinets, for example, of the laminar airflow type and, more particularly, to a counterbalance system for the sliding window of a biological safety cabinet.

Biological safety cabinets are used in a wide range of laboratory, research, and other applications. Such cabinets include back and side walls defining a work area inside the cabinet, a horizontal work surface located between the back and side walls, an open front providing access by the operator to the work area, and an airflow and high efficiency filtration system to provide barrier protection at the front opening to prevent release of biological agents and airborne particulates to the surrounding environment.

The front opening of the cabinet may be provided with a vertically sliding window to selectively permit access to the work area of the cabinet in an open position, and to close off the interior of the cabinet in a closed position to provide personnel, product and environmental protection. Biological safety cabinets are typically manufactured in sizes such as 4, 5 and 6 foot wide with 2 foot high front openings. A sliding window made of glass is typically on the order of ¼" (0.63 cm) thick and as such can weigh as much as 40 pounds. Prior art mechanisms to assist in raising and lowering sliding windows include weights and pulleys, extension springs and pulleys, and sash springs and pulleys. However, none of these prior art methods provides a substantially constant rate force spring, and thus at different window positions the user is required to apply substantially more or less force to operate the window.

SUMMARY OF THE INVENTION

It is among the principal objects of this invention to provide an improved safety cabinet vertical window lift assist system which requires substantially the same amount of force to operate the window regardless of window position. To this end, the improved design employs one or more pneumatic springs operatively connected to the cabinet and sliding window to counterbalance the window's weight. Use of one or more pneumatic springs makes the required force from the operator to raise or lower the window nearly equal resulting in much smoother and easier operation. In a presently preferred form of the invention, the safety cabinet includes back and side walls, a work area interiorly of the cabinet between the back and side walls, an open front, and a sliding window at the open front to permit selectively opening and closing of the unit to provide access to the work area by the operator as needed.

The pneumatic spring includes a cylinder having two ends and a cavity defined therein, a piston defining two working chambers within the cavity connected to a piston rod, and a pressurized gas in the working chambers. The cylinder is fixed at one end to the cabinet and the piston rod at the opposite end of the cylinder is operatively connected by means of cables and pulleys to the sliding window. The window frame includes at its vertical side edges rollers which engage tracks attached to the cabinet such that as the user raises and lowers the window the rollers slide along the tracks and the gas spring system counterbalances the weight of the window with a substantially constant rate force regardless of window position.

DETAILED DESCRIPTION OF THE INVENTION

Figure 1:
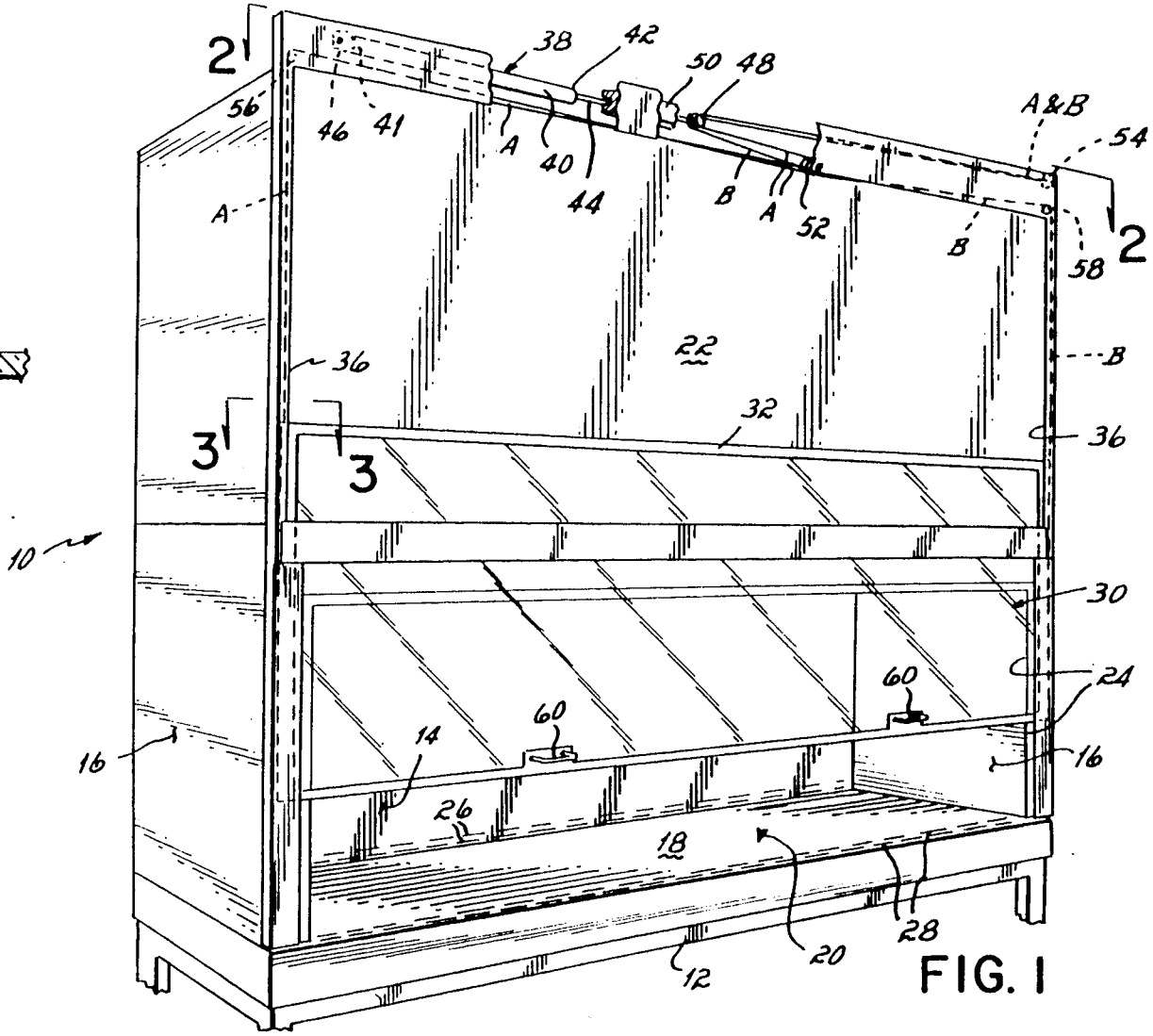
FIG. 1 is a isometric illustration of a biological safety cabinet with parts broken away to show the location of the pneumatic spring and counterbalance system of the present invention.

The biological safety cabinet 10 can be of a number of types, e.g., either a bench top unit or console type unit, and may include a base 12, a rear wall 14, side walls 16, a horizontal work surface 18 between the rear 14 and side 16 walls defining an interior work area 20, and a front panel 22 which provides access to internal parts (not shown) such as a high efficiency air filter and blower motor for controlling airflow through the unit 10. The work area 20 interiorly of the cabinet 10 is accessed through a front opening 24.

In a typical biological safety cabinet, air passes through a high efficiency filter and separates at the center of the work area 20. A desired percentage of the filtered air is pulled into a rear grill 26 by the blower motor which may be located either above or below the work surface 18 while the remaining filtered air combines with room air drawn in through the front opening 24 and pulled into a front intake grill 28 and then either into the bottom of the cabinet or into a back plenum for return to a blower above the work area 20. Such an air movement and filtration system provides an air barrier at the front opening 24 of the cabinet 10 preventing escape of biological agents and airborne particulates to the atmosphere. That is, since contaminated air is continuously drawn to the high efficiency filter and room air is continuously drawn into and through the front opening 24, flow of contaminated air out of the unit is prevent.

A sliding window 30 extends across the front opening 24 to permit the operator to selectively open and close the unit 10 as desired permitting access to the work surface 18 contained therein to either add items thereto or remove items from the cabinet. The window 30, which may be made glass, is mounted in a frame 32. Rollers 34 (FIG. 3), for example, stainless steel rollers, are attached to the upper and lower vertical sides of the frame 32 and engage the edge of a track 36 mounted to the front of the cabinet 10. A flexible plastic gasket 35 provides a seal along the vertical side edges and across the top of the window 30 while permitting its sliding movement.

A pneumatic spring 38 is mounted at the top of the cabinet behind the front panel 22 so as not to be visible to the operator or others from the front of the cabinet 10. Pneumatic springs are known to the art and thus will not be described in detail. In general terms, the spring 38 (FIG. 2) includes a cylinder 40 having first 41 and second 42 ends, a cavity defined therein, and a piston 43 reciprocal in and defining two working chambers in the cylinder cavity. The gas spring 38 is fixed at its first end 41 to the cabinet 10 by a bracket 46 permitting the cylinder 40 to pivot. A piston rod 44 connected to the piston 43 extends out of the second end 42 of the cylinder 40, and has a pulley 48 attached at its end opposite the cylinder 40. Pulley 48 in turn is mounted in a slide 50 permitting sliding movement of the pulley 48 with extension and retraction of the piston rod 44. An idler pulley 52 is fixed to the cabinet.

Figure 3:
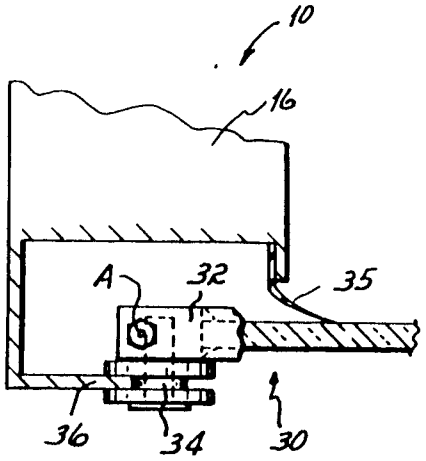
FIG. 3 is a view taken along line 3—3 of FIG. 1.

A first cable, cable A, which may be a 0.094" stainless steel cable rated for 940 pounds is fixed at one end to a bracket 54 attached to the cabinet 10. Cable A passes over the sliding pulley 48, over the idler pulley 52, then downwardly over a fixed pulley 56 where it is attached to the top side edge of the window frame 32 at A (FIG. 3). A second cable, cable B, of identical construction, is likewise fixed at one end to bracket 54, passes over the sliding pulley 48, under the idler pulley 52, over a second fixed pulley 58 at the opposite edge of the cabinet, and downwardly to the opposite side edge of the window frame 32 where it likewise is fixed to the window frame.

In operation, as the window 30 is lowered by the operator grasping handles 60 attached to the front of the window 30, the force on the cables A and B cause the piston rod 44 to extend out of the cylinder 40 with the sliding pulley 48 moving toward the idler pulley 52. The gas spring force counterbalances the weight of the window 30. Correspondingly, when the window is raised by lifting up on the handles 60, the gas spring assists in providing a lifting force as the gas works on the piston to retract the piston rod 44 in the cylinder. As described above, the pneumatic spring 38 provides a substantially constant rate spring force; and, thus the force required of the operator to raise and lower the window 30 is nearly equal in all window positions making its operation smoother and easier for the operator.

Figure 2:
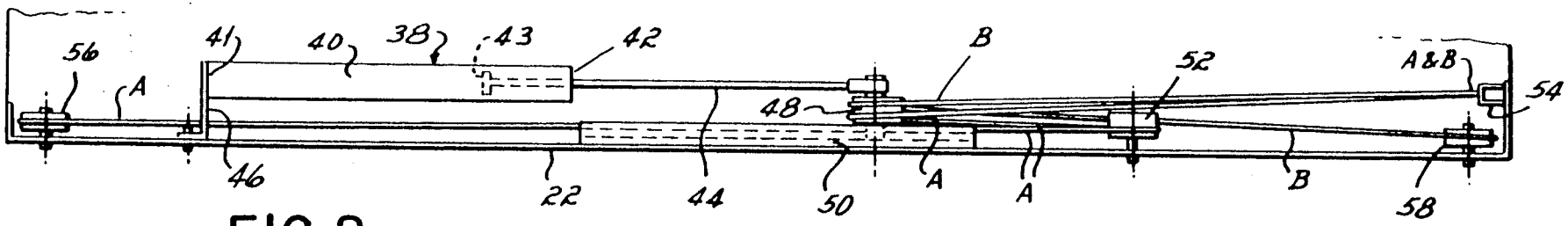
FIG. 2 is a view taken along line 2—2 of FIG. 1.
Figure 4:
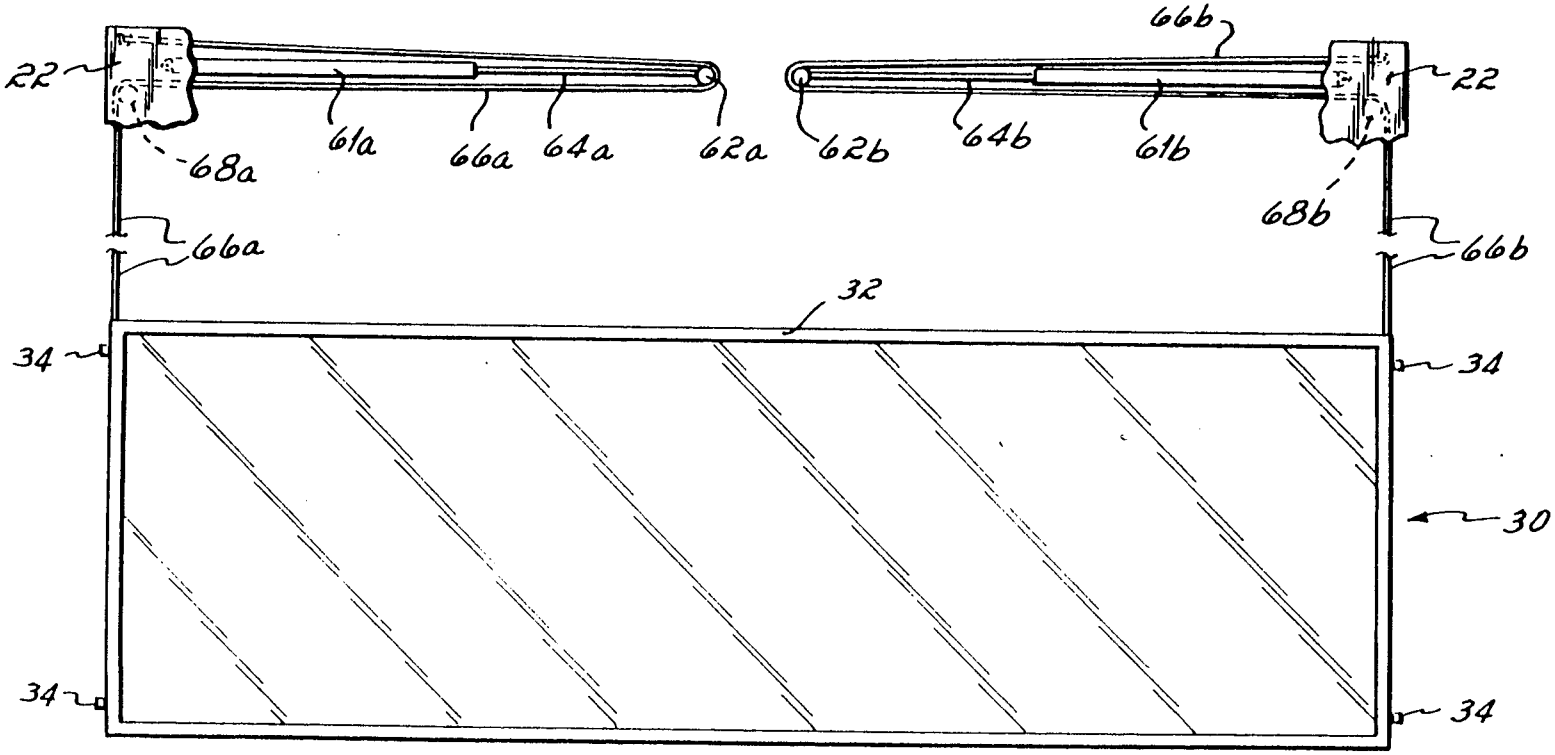
FIG. 4 is a schematic illustration of an alternative embodiment of the present invention.

Referring now to FIG. 4, there is illustrated an alternative embodiment employing two pneumatic springs 61*a, b* as opposed to one as shown in FIGS. 1 and 2. In the application shown schematically in FIG. 4, pneumatic springs 61*a, b* are each fixed at one end of the cylinder to the cabinet, for example, to the cabinet top or the rear of the front wall 22. Sliding pulleys 62*a, b* are attached to the ends of the piston rods 64*a, b* opposite the spring cylinders. Lifting cables 66*a, b* are each fixed at one end to either side edge of the cabinet, pass over the sliding pulleys 62*a, b* and in turn over fixed pulleys 68*a, b* mounted at either side edge of the cabinet, and down for attachment to the top side edge of the window 30. The gas springs have the same spring force rate. Thus when the window is lowered, the piston rods 64*a, b* are caused to be retracted in the cylinder and when raised the spring force causes the piston to extend out of the cylinder, again with a nearly equal spring force rate on both raising and lowering of the window.

Thus having described the invention what is claimed is:

1. A laboratory cabinet comprising:

back and side walls defining a work area interiorly of the cabinet;

a front opening extending between the side walls and allowing, access to said work area;

a sliding window including a pair of side edges operable for sliding movement in a vertical direction to selectively open and close said front opening of said cabinet;

at least one constant rate force pneumatic spring including a cylinder member having two ends and a cavity defined therein, a piston reciprocal in said cavity of said cylinder and defining two working chambers within said cavity, a pressurized fluid in said two working chambers, and a piston rod connected at one end to said piston and having an opposite end;

a pulley mounted at said opposite end of said piston rod for sliding movement with movement of said piston rod; and cable means attached at one end to said cabinet and at its other end to the side edges of said window, said cable means passing over said pulley thereby being operatively connected to said pneumatic spring in turn operatively connecting said window to said pneumatic spring such that said pneumatic spring provides a substantially constant rate spring force to assist in raising and lowering of said window with the application of a substantially equal operator force.

2. The laboratory cabinet of claim 1 comprising a single pneumatic spring pivotally attached to said cabinet and further comprising a pair of pulleys fixed to the sides of the cabinet and wherein said cable means comprises a pair of cables each fixed at one end and passing around said pulley mounted at said opposite end of said piston rod and over said fixed pulleys and attached to said window.

3. The laboratory cabinet of claim 1 comprising a pair of pneumatic springs each having a pulley mounted at the end of the piston rod opposite the spring cylinder and further comprising a pair of pulleys fixed at the side edges of said cabinet and wherein said cable means comprises a pair of cables, each cable fixed at one end to a respective side edge of said cabinet passing over the sliding pulley over the fixed pulleys and attached to the side edges of said window.

* * * * *